US005788413A

United States Patent [19]

Peggs

[11] Patent Number: 5,788,413

[45] Date of Patent: Aug. 4, 1998

[54] GEOCOMPOSITE MEMBRANE

[75] Inventor: Ian D. Peggs, Ocean Ridge, Fla.

[73] Assignee: I-Corp International, Inc., Boynton Beach, Fla.

[21] Appl. No.: 620,791

[22] Filed: Mar. 28, 1996

[51] Int. Cl.[6] ..... B03B 3/00

[52] U.S. Cl. ..... 405/129; 52/169.14; 405/270; 425/117

[58] Field of Search ..... 405/270, 43, 45, 405/129, 107, 108, 109; 52/169.14, 169.5; 428/117

[56] References Cited

U.S. PATENT DOCUMENTS

| | | | |
|---|---|---|---|
| 3,445,322 | 5/1969 | Saiia et al. | 52/169.14 X |
| 3,466,827 | 9/1969 | Clem | 52/446 |
| 3,561,177 | 2/1971 | Agro et al. | 52/173 |
| 4,070,839 | 1/1978 | Clem | 52/448 |
| 4,344,722 | 8/1982 | Blais | 405/270 |
| 4,467,015 | 8/1984 | Clem | 428/454 |
| 4,501,788 | 2/1985 | Clem | 428/240 |
| 4,565,468 | 1/1986 | Crawford | 405/270 |
| 4,693,923 | 9/1987 | McGroaty et al. | 428/148 |
| 4,943,185 | 7/1990 | McGuckin et al. | 405/45 |
| 5,041,330 | 8/1991 | Heerten et al. | 428/213 |
| 5,180,255 | 1/1993 | Alexander | 405/270 |
| 5,187,915 | 2/1993 | Alexander | 52/169.14 X |
| 5,501,753 | 3/1996 | Stark | 156/70 |

OTHER PUBLICATIONS

D. Carson; "U.S. EPA Experiences with Geosynthetic Clay Liners"; pp 25–37; Date Unknown.

Daniel et al; "Landfill Liners From Top to Bottom"; Civil Engineering, Dec. 1991.

*Primary Examiner*—Dennis L. Taylor

*Attorney, Agent, or Firm*—Hayes, Soloway, Hennessey, Grossman & Hage, P.C.

[57] ABSTRACT

A water and oil impermeable geosynthetic clay liner is formed by supporting a layer of bentonite on an impermeable plastic layer. Integrally formed protrusions extend from one surface of the plastic layer to support a permeable plastic cover layer. The cover layer confines the bentonite clay layer and is heat sealed to the protrusions.

8 Claims, 1 Drawing Sheet

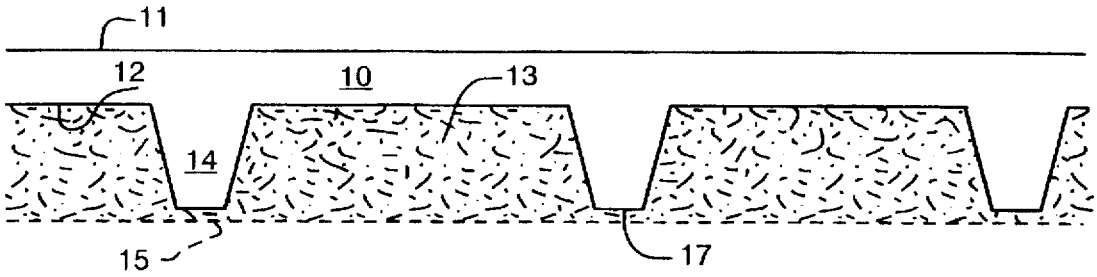
FIG. 1
FIG. 4
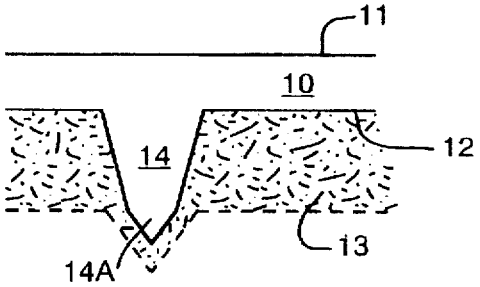
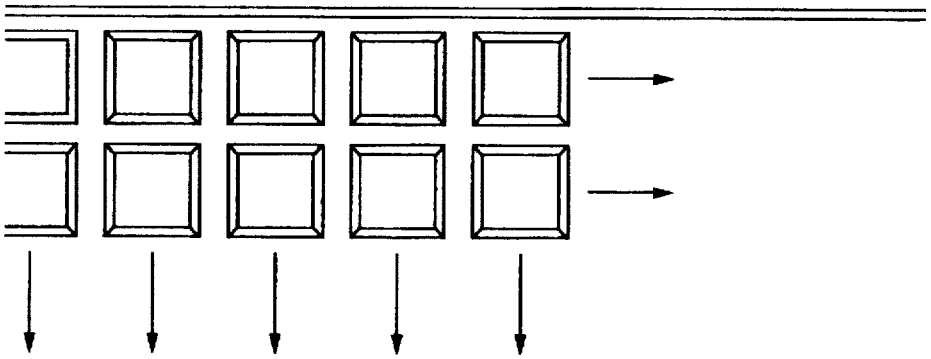
FIG. 2
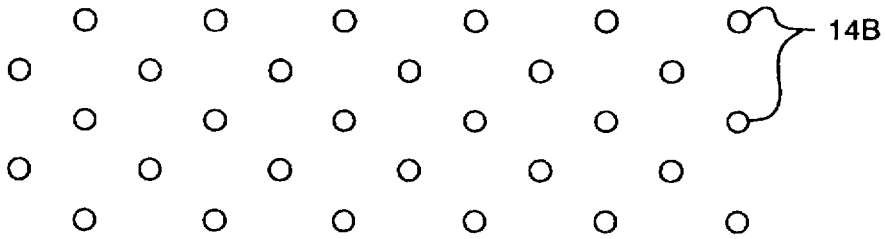
FIG. 3

GEOCOMPOSITE MEMBRANE

BACKGROUND OF THE INVENTION

1. Field of the Invention

The present invention relates to water and/oil-impermeable sealing mats and membranes and more particularly to water and/or oil-impermeable sealing mats and membranes particularly suitable as a water and/or oil barrier for hydraulic engineering, for environmental pollution control for the building of ponds, lagoons, as a soil sealant for hazardous or nuclear waste or for the retention of animal waste as, for example, on farms, and similar uses.

2. Description of the Prior Art

In the past, bentonite was widely used in various forms to act as a water barrier. So it is already known to provide seepage resistant structures by employing a mass of swellable bentonite across the path of possible seepage or flow. One such method and composition for impeding the seepage or flow of water is disclosed in U.S. Pat. No. 2,277,286 (Bechtner). As therein more fully described, commercial bentonite is used to block leakage or flow of water seepage, and structures of various types are safeguarded against leakage by blocking the path of flow of the water with bentonitic or highly colloidal clay which possess the capacity to swell and gelatinize upon contact with water.

A typical water barrier panel is shown in U.S. Pat. No. 4,048,373 which comprises two opposing spaced sheets using a sealing composition between the sheets that has bentonite in it, with a water soluble dispersing agent. This type of a panel is used against a foundation to act as a water barrier shielding the foundation, and is essentially a corrugated paper board carrier filled with finely granulated bentonite. This patent does describe the well-known waterproofing characteristics of bentonite, but the structure disclosed fails to provide the durability and adaptability of the present device.

U.S. Pat. No. 4,048,373 is a continuation-in-part of U.S. Pat. No. 3,949,560 which includes substantially the same disclosure, and a divisional patent U.S. Pat. No. 4,103,499 also shows the same type of a water barrier panel. Related U.S. patents, from the same family of applications, include U.S. Pat. Nos. 4,021,402 and 4,139,588.

U.S. Pat. Nos. 4,126,543 and 4,194,970 show a method of screening bentonite material for use in obtaining correct size bentonite particles. These patents do not show waterproofing panels as such.

U.S. Pat. No. 3,186,896 shows a facing sheet quite similar to that described in the prior patents, comprising a barrier panel made of corrugated paper board that is filled with bentonite.

U.S. Pat. No. 4,084,382 relates to a method for containing water having a high concentration of water soluble industrial wastes to reduce the likelihood of the wastes destroying the bentonite used. The bentonite is mixed with a water soluble dispersing agent and a water soluble polymer in a particular ratio to form a sealing compound.

U.S. Pat. No. 3,466,827 shows a roof panel that is formed to provide impervious construction, and is a self-sealing panel using a finely divided soluble bentonite clay in a layer.

U.S. Pat. No. 4,070,839 shows a moisture impervious panel that has a pair of spacing sheets interconnected by a central rigid support sheet, such as corrugated fiberglass. The corrugated sheet forms long pockets filled with a composition of bentonite and a compressed filler such as vermiculite. This construction forms a very rigid panel that is not usable in any form other than smaller sheets, and does not have sufficient flexibility to accommodate any substantial shifting of the surfaces that the panels are covering.

U.S. Pat. No. 4,467,015 shows another type of structure that has two layers, and which can be formed into a roll. Each layer includes a sheet of water permeable material and a coating of dry particles of bentonite on one surface of the sheet. An adhesive is used for applying the particles of bentonite to the water permeable material, and the bentonite particles are placed so that they face the surface of the structure that is to be waterproofed. The sheet shown in U.S. Pat. No. 4,467,015 has inherent problems with the cardboard or water permeable sheet, namely migration of water and leaking at the joints until the material attempts to self-seal. The material also is susceptible to rain damage and it needs protection against the weather when installed, until it is covered by backfilling or the like.

U.S. Pat. No. 3,676,198 shows apparatus for entraining bentonite particles in an air stream, and intermixing the particles with a coating material to cause the mixture to adhere in a layer onto a wall surface and provide for a waterproofing layer in that manner. The patent requires special on-site installation equipment.

U.S. Pat. No. 4,534,926 shows an uninhibited bentonite composition which comprises an intimate mixture of bentonite clay with polypropene, polybutene or mixtures thereof. The material is capable of being extruded through an extrusion dye and further a sheet-like material can be put between two release papers, but still has to be formed through an extrusion dye that has a wide opening to form a type of sheet.

Panels made in accordance with the foregoing U.S. Patents suffer from certain disadvantages. For example, when such panels are placed at the bottom of the pond and exposed to water, the water passes through the top layer of kraft paper and is adsorbed into the bentonite material. At the same time the paper loses its tensile strength due to the wetting process. The bentonite has the capacity to expand and swell in response to absorbing the water. This expansion of bentonite and the loss of tensile strength of the kraft paper cause the bottom sheet member and the cover sheet member to no longer hold together.

U.S. Pat. No. 4,693,923 shows a waterproofing sheet comprising a membrane of a water impervious material such as high density polyethylene, and a layer of bentonite. The bentonite layer is made up of a number of layers of bentonite particles with interspersed adhesive layers made into a sandwich type composite waterproofing sheet. However, a problem with this patented design is that it has very little sheet strength when the bentonite layer is hydrated into a gel. This can be a major problem when this sheeting is placed on slopes, particularly in landfills. Nor does this patented design have any means of containing the bentonite when it is hydrated in the absence of a confining pressure.

Thus, the art has proposed other ways to package bentonite material in sheets or rolls, which can be placed on the bottom of the pond or lagoon. In U.S. Pat. No. 4,501,788 is described a method for providing such a packaged bentonite sheet material utilizing the following steps:

(a) Using a support polyester sheet material (for example a porous non-woven fabric) having the ability to permit gases to escape therethrough in a lateral direction.

(b) Applying an adhesive to the upper surface of this sheet material, the adhesive being formed from a starch-like glue.

(c) Applying approximately one-fourth inch of bentonite on top of the adhesive.

(d) Spraying a second coat of adhesive over the top of the bentonite.

(e) Placing a scrim or fine mesh material on top of the adhesive.

(f) Press rolling the above combination into an elongated flat sheet material.

(g) Baking the sheet material in a long oven at approximately 300° F. so as to bake all the moisture out of the sheet material and the bentonite.

Not only is the above process cumbersome, expensive and time consuming, but also the support sheet and the cover sheet lose their firm contact with each other. This is a very important disadvantage, because the bentonite layer acts in a wet condition like a sliding path on the sides of the pond or other places. This sliding effect is further enhanced by the dissolved adhesive in the wet condition.

Therefore, other people tried by a further development to avoid at least one of the before mentioned shortcomings, that means to avoid the use of an adhesive and the necessary baking process by using such an adhesive. Such a new process which does not require baking or adhesive as above mentioned is disclosed in U.S. Pat. No. 4,565,468. The process of said patent involves the use of the following steps:

(a) Using a flat polyester sheet material, preferably a synthetic non-woven fabric which is a porous, flexible polypropylene material. The sheet material is capable of dissipating gas in a lateral direction so as to permit gas which gathers adjacent the sheet to pass laterally outwardly through the sheet material.

(b) Applying approximately one-fourth inch of bentonite over the top of the base material.

(c) Applying plain kraft paper or other biodegradable material over the top of the bentonite. This material must be capable of degrading after hydration.

(d) Stitching the sheet material to the base material with the bentonite being positioned between the two sheets of material. In the preferred form the stitches extend in crossing diagonal lines with respect to the longitudinal axis of the sheet material so as to form diamond shaped quilted compartments between the upper sheet material and the base sheet material. The quilted compartments contain bentonite therein. The quilted arrangement prevents the bentonite from shifting during the rolling of the quilted material and during transportation. In another form the kraft paper is corrugated so as to form elongated corrugated compartments for containing the bentonite material.

When the above material is placed within a water environment, such as at the bottom of a pond or lagoon, the bentonite expands and breaks the kraft paper layer at the top of the barrier. The bentonite continues expanding so as to cover the stitch holes formed by the stitching, and thereby forms a water impervious layer.

As seen from the above description it may be that the process for the production of the sheet material according to the U.S. Pat. No. 4,565,468 is better than according to the process of the U.S. Pat. No. 4,501,788 (corresponding to European Patent 0059625), but there is still the large disadvantage that the bentonite layer during the use as a water barrier in a wet condition acts like a sliding path on slopes. The bentonite may also squeeze out through the stitch holes and form a sliding layer on the surface of the sheet.

All of the sealing mats described in the above U.S. patents serve merely to "package" bentonite and always consist in principle of a substrate layer, a bentonite layer and a cover layer. After these sealing mats have been laid out and subsequently moistened, the substrate and cover layers are connected only via the swollen bentonite layer therebetween, which has the consistency of grease. Now if it is considered that the sealing mats must further be weighted down with a sand or soil filling and then with gravel or rocks not only on flat surfaces, but also on slopes, it is easily conceivable that such a filing on the swollen intermediate bentonite layer, which acts like a slide, slips off, which is often observed in practice.

Thus, in principle, the sealing mats described in the above-given U.S. patents, as already indicated, serve only to pack the bentonite in flat form, such that the cover layer disconnects from the substrate layer upon the swelling of the bentonite and a continuous bentonite layer takes shape. However, in reality such a bentonite layer can be produced more simply and inexpensively in situ in the manner described in the U.S. Pat. No. 4,344,722. Said patent provides a method and a system for waterproofing a desired substrate and further contemplates a waterproof and chemical-resistant product. The method comprises providing a length of flexible moisture-permeable thin, synthetic sheet material having desired characteristics, placing in contact with the substrate to be waterproofed a layer of the material, covering the layer of material with a central layer of bentonite (Montmorillonite clay) and placing on top of the bentonite a third layer of the fabric. The flexible moisture-permeable thin, synthetic sheet material is typically a non-woven fabric.

The foregoing discussion of the prior art is taken largely from U.S. Pat. No. 5,041,330 in which there is described a water and/or oil-impermeable sealing mat comprising a substrate layer and a cover layer each consisting of a non-woven textile material, and having a layer of bentonite therebetween. The three layers are bonded together by stitching whereby to maintain a layer of bentonite therebetween. While sealing mats such as described in U.S. Pat. No. 5,041,330 are believed to have achieved a certain amount of commercial use, such mats suffer from several disadvantages. For one, they have a relatively low internal sheer resistance when hydrated. Moreover, the bentonite powder may migrate downslope when such mats are placed on steep and vertical slopes when sheered a critical amount, the transverse fibers may break or pull out from the geotextile layers. Further, interfacial sheer strength between the sheet materials and the subgrade, when hydrated bentonite squeezes out through the sheet material, is relatively low.

Expired U.S. Pat. No. 3,561,177 to Agro et al describes a sheet to be adhesively secured to a building wall to be water proofed which comprises a paper layer adhesively secured to a compartmented plastic layer. Between these two layers is positioned a bentonite layer which is confined within the compartments in the plastic layer. This product does not describe a heat sealed multi layer plastic product having protrusions for anchoring the product to a soil surface.

While an article by Daniel and Koerner in Civil Engineering, December 1991, describes a geosynthetic clay liner as being made with a bentonite clay liner "sandwiched between geotextiles or attached to a geomembrane" it does not provide the advantages of the present invention. Similarly, a structured membrane showing ribs and spikes on opposite surfaces of a geomembrane are described in Geosynthetics "93. This geomembrane is not used as an integral structure in combination with a bentonite layer.

It is thus an object of the present invention to overcome the aforesaid and other disadvantages of the prior art.

BRIEF SUMMARY OF THE INVENTION

In accordance with the present invention there is provided a geocomposite liner comprising a base membrane formed of a water impervious plastic material, and having a plurality of raised stubs or ridges extending from one surface thereof, and supporting a plastic water permeable sheet in spaced relation to the surface of the membrane, and defining therebetween a space which is filled with finely divided bentonite material. The base element preferably is formed with the stubs or ridges integrally formed in a surface thereof, for example, by means of calendaring or vacuum forming. The plastic water permeable sheet is preferably heat scaled to the tops of the stubs or ridges. In a preferred embodiment of the invention, the membrane is usually on the top of the product, during use, and the bentonite layer is in the middle between the membrane and the geotextile layer. Similarly other penetrating stubs can be formed as localized extensions of the stub or ribs which define the pockets for confining the bentonite layer.

Of major importance is the interface sheer strength between the bentonite layer and the overlying geomembrane in landfill applications. In conventional GCL's, when bentonite squeezes out of the GCL it lubricates the interface with the geomembrane. In this invention, the stubs and ridges eliminate sliding on that interface since the geomembrane of the new GCL is also the landfill liner, the geomembrane faces up. Similarly the stubs and ridges preclude internal shearing in the bentonite layer.

Liner designs also require the geomembrane and clay layer to be in intimate contact to prevent sideways flow of leaking water along the interface. This is difficult to achieve in two separate components since the geomembrane can be wrinkled (wavy) during installation. In this invention, the clay/bentonite and geomembrane are always in contact with each other.

BRIEF DESCRIPTION OF THE DRAWINGS

Still other features and advantages of the present invention will become apparent from the following detailed description, taken in conjunction with the accompanying drawings wherein like numerals depict like parts, and wherein:

FIG. 1 is a cross-sectional view of one form of geocomposite liner made in accordance with the present invention;

FIG. 2 is a top plan view of the geocomposite liner of FIG. 1; and

FIG. 3 is a top plan of an alternative form of geocomposite made in accordance with the present invention.

FIG. 4 shows a modification of the FIG. 1 form.

DETAILED DESCRIPTION OF THE PREFERRED EMBODIMENTS

Referring now to FIG. 1, there is illustrated a diagramatic partially cross sectional view of one preferred embodiment of the invention. In FIG. 1 the GCL (geosynthetic clay liner) is generally indicated at 10 as an impermeable membrane having a top surface 11 and a bottom surface 12. On the bottom surface are a series of pockets 13, defined by ridges 14, which support a water permeable plastic bottom sheet 15. Within the pockets 13 (completely defined by the ridges, the top membrane, and bottom sheet 15) is a water swellable material such as bentonite particles. In a preferred form of the invention the water permeable bottom sheet 15 is heat sealed to the tops 17 of the ridges 14 to form a product in which the dry bentonite powder is firmly held in place.

In the preferred embodiment of the invention the membrane 10 is preferably formed of a heat deformable, water-impermeable plastic such as high density polyethylene or another material such as polyvinyl chloride, polypropylene, chlorinated polyethylene, chlorosulfonated polyethylene, ethylene interpolymer alloy, and linear low density polyethylene. The water permeable sheet 15 is a plastic textile which can be formed of similar synthetic heat sealable plastic fibers such as high density, polypropylene, polyethylene, polyester, etc. can be a woven or non-woven fabric with a mesh size sufficient to confine the dry bentonite particles. Equally the fibers can be polyester, polyacrylic, or polyamide fibers. The principal requirement being adequate strength and heat sealability. Preferably, the bentonite powder is in granulated and/or powdered form so that it has a particle size distribution of approximately 50 μm or less.

In a preferred form of the invention, the ridges 14 are about 0.5 centimeter high so that the confined bentonite layer has a thickness of 0.5 cm.

In a preferred use of this product, the water impermeable member layer 10 is placed toward the direction from which liquid tending to penetrate the seal approaches the seal. For example, if the GCL is to be used in the bottom of a landfill liner to prevent leakage of landfill leachate the layer 15 will face down. If the GCL is to prevent leakage of fluid from the bottom of the landfill liner into the surrounding soil, the layer 15 is placed down. Similarly, if the GCL is part of a permeable cover to a landfill, that is to prevent access of rain water to the covered material in the landfill, the permeable layer 15 would be placed down.

As shown in FIG. 4 at 14A, the ridges 14 can have similarly sharpened points or edges which can either penetrate the layer 15 or deform the layer 15 so that the ridge can act to secure the layer in place on the ground.

Referring now to FIG. 2, there is illustrated a plan view of the GCL of FIG. 1 with the permeable textile layer 15 removed. In this case, the ridges define square openings for holding the powdered bentonite.

A modification of the invention is shown in FIG. 3 wherein the interior portions of ridges 14 are replaced by stubs 14B which act to space the permeable textile layer above the layer of bentonite particle. The stubs 14B are sufficiently closely arranged so that they minimize deformation of the impermeable and permeably layers when the GCL is subjected to a confining pressure. Also the bentonite powder is sufficiently packed on the surface between the stubs 14B so that the product can be readily rolled for handling and installation as a portion of a landfill liner.

In a preferred form of the invention a high density polyethylene sheet of 1.5 mm thickness is embossed to provide a structure as shown in FIG. 3. This has stubs 14B which are 6 mm high and spaced 15 mm apart. This sheet is coated under a doctor blade with at layer of bentonite granules having a particle size of approximately 50 μm or less. The covered geotextile layer 15 typically comprises a non-woven textile of polypropylene with a mass per unit area of approximately 250 g/m$^2$, or to suit the specific lining system requirements. Alternatively a woven geotextile may be used. The cover layer 15 is bonded to the tops of the stubs 14B or the ridges 14A by a hot iron or similar thermal bonding process. The resultant product can be rolled up for shipping and placed in the field with either surface 15 or 11 up or down without disturbing the bentonite layer.

The version with the stubs will be used primarily on flat surfaces and shallow slopes. The version with the ridges will be used primarily on steeper slopes and vertical walls.

Another advantage of this type of GCL is that it will not compress and allow the bentonite to be totally squeezed out under a confining pressure or at local pressure points.

I claim:

1. A geosynthetic clay liner for protecting a surface or area against damage due to liquid seepage comprising:

a liquid impervious layer formed of a heat sealable plastic positioned toward the direction from which liquid seepage approaches, said layer having a series of integrally formed elements extending generally normal to said layer, to provide a plurality of areas extending normally to said surface;

a layer of liquid swellable material supported on said plastic layer, said liquid swellable layer having a thickness no greater than the height of said integral elements as measured normal to the layer surface; and a liquid permeable plastic layer covering said liquid swellable layer and heat sealed to the tops of said integrally formed elements, said integrally formed plastic elements being arranged in such a geometric form that said layer of liquid swellable material is confined by said normally extending areas to prevent lateral movement of the water swellable material before and after said water swellable material is contacted by liquid.

2. The geosynthetic clay liner of claim 1, wherein said water permeable layer is a textile material.

3. The geosynthetic clay liner of claim 2, wherein said textile material has openings between the individual threads thereof which are smaller than the size of the bentonite particles.

4. The geosynthetic clay liner of claim 1, wherein said impermeable layer is formed of polyethylene.

5. The geosynthetic clay liner of claim 1, wherein said integral elements comprise stubs of a first height.

6. The geosynthetic clay liner of claim 1, wherein said integral elements comprise ridges of a first height.

7. The geosynthetic clay liner of claim 1 wherein the tops of said elements are pointed so as to penetrate an adjacent soil layer.

8. The geosynthetic clay liner of claim 1 wherein said liquid swellable material is bentonite.

* * * * *